US005367840A

United States Patent [19]

West

[11] Patent Number: 5,367,840

[45] Date of Patent: Nov. 29, 1994

[54] METHOD AND SYSTEM FOR THE ABRASIVE CLEANING OF SURFACES

[76] Inventor: Richard A. West, 31303 Nantucket Row, Bay Village, Ohio 44140

[21] Appl. No.: 37,274

[22] Filed: Mar. 26, 1993

[51] Int. Cl.[5] ..... B24C 5/02; B24C 7/00

[52] U.S. Cl. ..... 451/78; 451/90; 451/456

[58] Field of Search ..... 51/415, 424, 425, 427, 51/410, 273

[56] References Cited

U.S. PATENT DOCUMENTS

| | | | |
|---|---|---|---|
| 2,455,514 | 12/1948 | Mead | 51/415 |
| 4,505,077 | 3/1985 | Sheesley et al. | 51/415 |
| 4,624,080 | 11/1986 | Jakobsson | 51/415 |
| 5,097,633 | 3/1992 | Branton | 51/415 |

FOREIGN PATENT DOCUMENTS

| | | | |
|---|---|---|---|
| 0223389 | 6/1985 | Germany | 51/425 |

*Primary Examiner*—Robert A. Rose

*Attorney, Agent, or Firm*—Vickers Daniels & Young

[57] ABSTRACT

A system for abrasively cleaning surfaces such as by sandblasting and including a vacuum arrangement for recovering the material abrasively removed from the surface as well as the abrasive material is provided with a control circuit operable to actuate an alarm and/or deactivate the abrasive cleaning operation by sensing a drop in the vacuum pressure at the blast head which is indicative of an inappropriate positioning of the blast head and thus discharge of the abrasively removed material and abrasive material to the surrounding environment.

17 Claims, 3 Drawing Sheets

METHOD AND SYSTEM FOR THE ABRASIVE CLEANING OF SURFACES

BACKGROUND OF THE INVENTION

This invention relates to the art of abrasively cleaning surfaces and, more particularly, to a method and system for issuing an alarm and/or interrupting the cleaning operation in response to the occurrence of an undesirable condition during the cleaning operation.

The present invention finds particular utility in lead abatement sandblasting operations and, accordingly, will be disclosed and discussed in detail herein and in conjunction therewith. At the same time, however, it will be appreciated that the invention is applicable in general to any system for abrasively cleaning surfaces wherein the material abrasively removed from the surfaces is collected through the use of a vacuum arrangement in the system.

It is of course well known that lead is hazardous to the health of human beings and is especially harmful to children. Moreover, within the last five years researchers have found that lead is actually much more hazardous than previously thought. It is likewise well known that lead was a common component in industrial paint until about ten years ago, and it is estimated that about eighty percent of all existing bridges, tanks and other structures requiring maintenance by periodic painting currently have paint thereon which is lead based. Proper maintenance of these structures requires a complete removal of the existing paint and repainting thereof about every ten years, and the safe removal of the existing paint, at a reasonable cost, is a serious problem. In this respect, for example, EPA regulations state that a maximum release of dust equal to 150 mg/m$^3$ over a twenty-four hour period is acceptable during paint removal. A maximum release of airborne lead equal to 1.5 mg/m$^3$ is allowed. Compliance with these regulations is verified through air samples taken downwind of the surface being cleaned, and if the release is in excess of the regulations, unacceptable contamination of air, soil, water and property has taken place. Still further, OSHA regulations state that persons such as personnel operating lead abatement abrasive blasting apparatus are not to be exposed to airborne lead levels in excess of 50 mg/m$^3$, and air monitors are worn by such personnel to verify that they have or have not been exposed to excessive lead levels. In view of the increasing concern for the harmful effects of lead, these regulations are expected to be made more stringent in the future. Still further, SSPC standards currently require that a containment be built around an area being abrasively cleaned. Such containments are not only very expensive to construct but, in use, material which is released at the surface being cleaned is only contained in a given area determined by the containment and the latter has no capability with respect to controlling release of material including contaminants from the abrasive cleaning apparatus per se.

Currently, the methods for removing existing lead based paint include conventional abrasive blasting with a containment as mentioned above and which includes an air ventilation system and dust collectors. Accordingly, in addition to the cost of construction and the containment limitation mentioned above, such a system is expensive to operate and maintain. Moreover, while containing contaminants and other materials to the work area and thus minimizing the escape thereof to the surrounding environment, the containment defines an area of confinement for the worker in which contaminants hazardous to the worker's health, including lead, are in an undesirably high concentration due to the confinement. Chemical stripping is another method currently used for removing lead based paints, but this method is also very expensive and, additionally, exposes workers to noxious chemicals as well as fumes emanating from chemical deterioration of the paint, whereby extreme care including special clothing and the like is required to protect workers. Other equipment for abrasively removing lead based paints as well as other materials from surfaces includes systems for impacting steel needles against a surface to be cleaned, hand-held rotary devices which abrasively remove paint or other materials by a rotary peening action, and abrasive blasting apparatus by which an abrasive such as sand is impacted against the surface to be cleaned by air under pressure, all of which systems include a vacuum attachment on the hand held component for recovering material removed from the surface as well as the needles and abrasive material in the corresponding systems. With all devices of the latter type, the face of the hand held component must be maintained in flush contact with the surface being cleaned to avoid or minimize the escape of the abrasive material and the material removed from the surface. If properly positioned in this respect, the vacuum serves to recover the material removed from the surface, or the latter material and the abrasive material by which such material is removed from the surface. If the face of the tool is canted relative to the surface being cleaned, or is moved away from the surface, there is a drop in the vacuum pressure which results in the material being removed from the surface or the latter material and the abrasive material not being sucked into the vacuum attachment but, rather, being dispersed into the surrounding work area. This not only releases contaminants into the latter area but, in connection with abrasive blasting, results in a loss of the abrasive material. In connection with the undesirable release of contaminants and/or abrasive material, a major problem is that the contamination of the surrounding environment as a result of such release is not known until the release has occurred and the damage is done.

SUMMARY OF THE INVENTION

In accordance with the present invention, a system for abrasively cleaning a surface and recovering the material removed therefrom and, if applicable, the abrasive material, is provided with a control arrangement by which the foregoing problems are minimized by reducing the release of contaminants and other material into the surrounding environment. This promotes safety for the operator and minimizes the potential for contaminating the environment while rendering the cost of operating the equipment more economical. More particularly in accordance with the invention, the control arrangement is responsive to a reduction in vacuum at the face of the abrasive cleaning tool resulting, for example, from canting of the latter relative to the surface being cleaned and, in response to such pressure drop, activates an alarm and/or interrupts the cleaning operation until such time as the condition is corrected by the operator of the equipment. Preferably, the control provides both functions so as to avoid the possibility of the operator of the equipment ignoring the alarm. Further, the alarm can be visual and/or audible, and it is preferred to provide for the alarm to be visual and on the hand held component so as to minimize the alarm escaping the operator's attention. In any event, the control indicates the unacceptable condition at the tool head to the operator, and encourages the operator to pay close attention to the operation of the apparatus so as to preclude the occurrence of an alarm and/or shutdown condition. In either event, the system is operated more economically by increasing the recovery of contaminant or contaminant and abrasive material and is operated with improved efficiency in reducing contaminant release by requiring the workman to take immediate corrective action to overcome the alarm and/or shutdown condition. When the operator appropriately repositions the tool face relative to the surface, the vacuum increases and the alarm is disabled and/or the abrasive cleaning process is resumed.

It is accordingly an outstanding object of the present invention to provide an improvement in connection with the operation of a system for abrasively cleaning a surface and wherein a vacuum is provided at the face of the cleaning head of the system for recovering material removed from the surface by the abrasive cleaning action.

Another object is the provision of an improvement of the foregoing character which minimizes the release of contaminants or other materials removed from the surface into the surrounding environment.

Yet another object is the provision of a system for abrasively cleaning a surface with a control arrangement responsive to an undesirable condition of the system to activate an alarm and/or to interrupt operation of the system until such undesirable condition is removed.

Another object is the provision of a system of the foregoing character which is operable more efficiently than heretofore possible with respect to recovery of material removed from a surface and recovery of an abrasive material used to remove such material from the surface.

Yet another object is the provision of a system of the foregoing character which provides the operator of the system equipment with an indication of the undesirable condition regarding operation of the equipment, thus enhancing the operator's correction of the condition so as to minimize losses in material recovery and to enhance efficient operation of the equipment by the operator.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which:

Referring now in greater detail to the drawings, wherein the showings are for the purpose of illustrating preferred embodiments of the invention only and not for the purpose of limiting the invention, FIG. 1 illustrates an air pressure operated abrasive blasting system 10 for cleaning a surface S which, while not designated numerically, will be understood to include a material to be removed such as a lead-based paint. System 10 includes a hand-held blast head 12 which operates as set forth more fully hereinafter to direct abrasive material against surface S and to facilitate the recovery of the abrasive material and the material removed from surface S. The system further includes a pressure tank 14 for an abrasive material A, such as sand, and a vacuum tank 16 for the recovery of abrasive material and material removed from surface S, separation of the two materials, and return of the abrasive material to pressure tank 14 for reuse in the system, all of which is well known in conjunction with abrasive blasting systems. A vacuum is adapted to be generated in vacuum tank 16 by means of a vacuum pump 18 driven by a suitable motor 20 which, in the embodiment illustrated, is an electric motor adapted to be connected across a 110 volt power source 22 through an appropriate on-off control switch, not shown.

Figure 1:
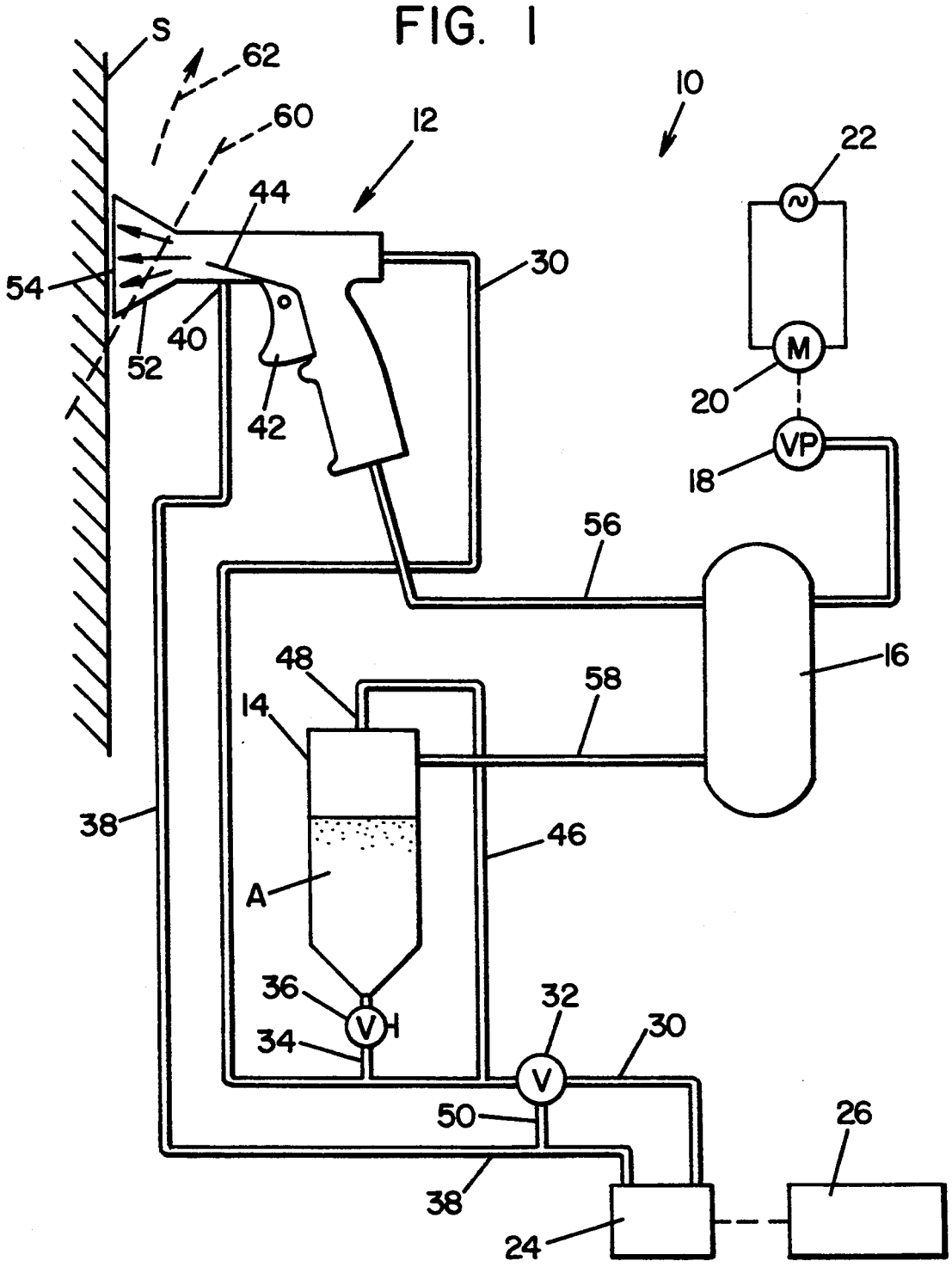
FIG. 1 is a schematic illustration of one form of a system for abrasively cleaning a surface adapted to be provided with a control arrangement according to the invention.

Abrasive material A in tank 14 is adapted to be delivered to blast head 12 by air under pressure, the source of which is provided by a compressor 24 driven by a suitable power source which, in the embodiment illustrated, is an internal combustion engine 26. Compressor 24 has a primary outlet line 30 connected to blast head 12 through a normally closed pressure responsive valve 32 between compressor 24 and tank 14, and tank 14 has a discharge line 34 connected to line 30 across an adjustable metering valve 36 by which the quantity of sand flowing from the tank to line 30 can be controlled. Compressor 24 has a secondary outlet line 38 extending to blast head 12 and having an outlet end 40 opening into the blast head, and the blast head is provided with a trigger 42 controlling a normally open valve 44 for opening and closing discharge end 40 of line 38 for the purpose set forth hereinafter. Compressor discharge line 30 connects with a branch line 46 on the downstream side of valve 32 and which branch line has an outlet end 48 opening into tank 14 above abrasive material A therein. Branch line 46 serves as described hereinafter to maintain pressure behind the abrasive material to assure discharge thereof from tank 14. Valve 32 is normally closed and is adapted to be opened as set forth more fully hereinafter by air under pressure in line 38 which is connected thereto by line 50. Blast head 12 includes a shroud 52 terminating in a face 54 which is held flush with surface S during a cleaning operation. Abrasive material A is delivered to shroud 52 under pressure through line 30 for distribution against surface S. Blast head 12 further includes a vacuum line 56 connected to vacuum tank 16, whereby a vacuum is generated in shroud 52 for conveying the abrasive material and the material removed from surface S to vacuum tank 16. As is well known, the material removed from surface S is separated from the abrasive material in vacuum tank 16 and the abrasive material is returned to pressure tank 14 through a line 58 for recirculation to blast head 12.

In operation, engine 26 is started to operate compressor 24 whereupon air under pressure is delivered through line 38 into blast head 12 across normally open valve 44. At the same time, motor 20 is energized to operate vacuum pump 18, whereby tank 16 vacuumized and a vacuum is generated in blast head 12 and shroud 52 through line 56. At this time, valve 32 is closed whereby there is no flow of compressed air to the blast head through line 30 or to pressure tank 14 through line 46. When the operator depresses trigger 42 of blast head 12, valve 44 closes open end 40 of line 38. This creates a back pressure in line 38 which opens pressure responsive valve 32 through line 50, whereby air under pressure flows through line 30 from compressor 24 and carries abrasive material from tank 14 through line 30 into blast head 12 and through shroud 52 against surface S. At the same time, the opening of valve 32 communicates air line 30 with tank 14 through branch line 46, whereby air under pressure is introduced behind abrasive material A in tank 14 to assure delivery thereof to line 30. The abrasive material discharged through shroud 52 of blast head 12 against surface S, together with the material abrasively removed thereby from surface S, is withdrawn from the blast head through line 56 and delivered to vacuum tank 16. As mentioned above, the abrasive material is separated in tank 16 from the material removed from surface S and is returned to pressure tank 14 through line 58. When the operator releases trigger 42, valve 44 opens the discharge end 40 of line 38 causing a pressure drop in line 38, whereby valve 32 closes and thus interrupts the delivery of abrasive material to the blasting head. When the operator again depresses trigger 42, the foregoing abrasive blasting operation is resumed.

If during the foregoing operation of the abrasive blasting system, the operator cants blasting head 12 relative to surface S so that face 54 of shroud 52 of the blast head is disposed at an angle to surface S, as indicated by broken line 60, it will be appreciated that a portion of the abrasive material as well as a portion of the material abrasively removed from surface S will be blown laterally outwardly from the blasting head, as indicated by arrow 62, and thus into the surrounding environment. Depending on the frequency of such inappropriate positioning of face 54 relative to surface S during a surface cleaning operation, it will be appreciated that such escape of the material removed from surface S can quickly exceed acceptable limits. Furthermore, unless the operator is extremely attentive to the disposition of face 54 relative to surface S, such inappropriate positioning can occur frequently.

Figure 2:
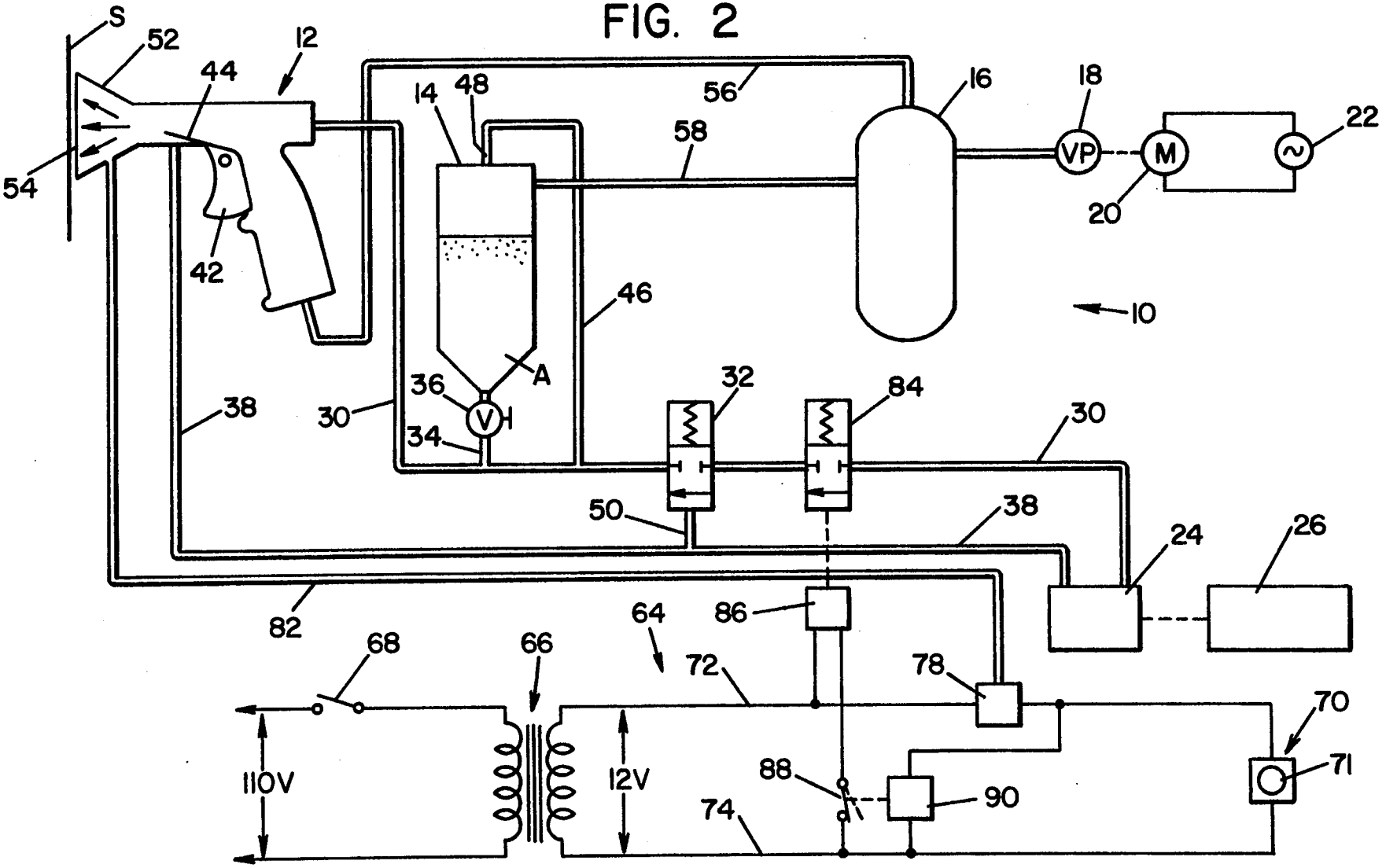
FIG. 2 is a schematic illustration of the system shown in FIG. 1 provided with a control arrangement in accordance with the present invention.

In accordance with the present invention, a system such as that described above for abrasively cleaning a surface is provided with a control arrangement for indicating an inappropriate positioning of face 54 of the blast head relative to the surface by actuating an alarm and/or interrupting the delivery of abrasive material to the blasting head. More particularly in this respect, as shown in FIG. 2, system 10 is provided with a control arrangement which includes an electric circuit 64 suitably energized such as through a transformer 66 having its primary connected to a 110 volt source through a manually operable on-off switch 68. An alarm device 70 is connected across lines 72 and 74 of the secondary of transformer 66 through a normally closed vacuum actuated switch 78 connected to blast head 12 by line 82 and adapted to be open in response to a predetermined vacuum pressure in the system. The control arrangement further includes a normally closed valve 84 in compressor discharge line 30 between valve 32 and compressor 24. Valve 84 is adapted to be displaced to its open position by solenoid 86 which is connected across secondary lines 72 and 74 of circuit 64 through a normally closed, solenoid operated switch 88. Switch 88 is adapted to be opened by solenoid 90 which is connected across secondary lines 72 and 74 so as to be controlled by switch 78. In the embodiment illustrated, alarm 70 includes a visual alarm in the form of a light 71 which, preferably, is located on blast head 12 so as to be readily visible to the operator of the system.

In operation of the abrasive blasting system and control arrangement shown in FIG. 2, abrasive blasting system 10 operates in the manner described hereinabove in conjunction with FIG. 1. Therefore, assuming that vacuum pump 18 and compressor 24 have been activated, a vacuum is generated in vacuum tank 16 and in blast head 12 through line 56, and at switch 78 through line 82. At the same time, air under pressure is delivered from compressor 24 to the blast head through line 38, and valve 32 is closed whereby there is no air flow through line 30 to the blast head. Assuming that the operator has not yet positioned face 54 of shroud 52 against surface S to be cleaned, the vacuum in line 82 is at a low level whereby vacuum actuated switch 78 remains in its normally closed position. When on-off switch 68 is closed, either before or after activating system 10 in the foregoing manner, the secondary of the control circuit is energized and alarm 70 is connected across switch 78 to energize light 71. Further, closed switch 78 connects solenoid 90 across secondary lines 72 and 74, whereby normally closed switch 88 is displaced to its open position opening the circuit to solenoid 86. Accordingly, solenoid 86 is deenergized and valve 84 in line 30 is biased to its normally closed position.

When the operator positions face 54 of shroud 52 against surface S, the vacuum in shroud 52 and thus in line 82 increases to a level which opens normally closed vacuum switch 78. This deenergizes solenoid 90, whereupon switch 88 closes to energize solenoid 86 and open valve 84 in line 30. The opening of switch 78 also deenergizes alarm 70 whereby light 71 is extinguished. The operator then depresses trigger 42 to begin the abrasive cleaning operation and, as described hereinabove in conjunction with FIG. 1, the depressing of trigger 42 closes valve 44 to open valve 32 in line 30. Upon opening of valve 32 air under pressure from compressor 24 flows through line 30 carrying abrasive material from tank 14 to blast head 12. Air from compressor 24 also flows through line 46 to pressurize tank 14. Under these conditions the circuit to alarm 70 and solenoid 90 remains open through vacuum switch 78.

So long as the operator maintains face 54 of shroud 52 appropriately oriented relative to surface S the system continues to operate with the component parts in the operating modes just described. If the operator cants face 54 relative to surface S, the vacuum pressure in shroud 52 and thus in line 82 is reduced. The reduced vacuum is sensed by vacuum actuated switch 78 whereupon the switch returns to its normally closed position. The closing of switch 78 connects alarm 70 across lines 72 and 74 to energize light 71 indicating the inappropriate positioning of the blasting head. At the same time, the closure of switch 78 connects solenoid 90 across secondary lines 72 and 74 to energize the solenoid and displace switch 88 to its open position whereupon solenoid 86 is deenergized to close valve 84. Therefore, even though the operator maintains trigger 42 depressed whereby valve 32 remains open, valve 84 blocks the flow of air from compressor 24 and thus the delivery of abrasive material to the blast head. If the operator appropriately repositions face 54 relative to surface S without releasing trigger 42, the vacuum in shroud 52 and thus in line 82 is again increased to open vacuum actuated switch 78 whereupon alarm 70 and solenoid 90 are deactivated. The deactivation of solenoid 90 closes switch 88 to reconnect solenoid 86 across lines 72 and 74 so that valve 84 opens and the abrasive blasting operation resumes.

In addition to providing environmental and health safety by precluding the discharge of abrasive material and/or providing an alarm signal in response to inappropriate positioning of the blasting head relative to the surface being cleaned, the control arrangement advantageously functions as an educational aid in teaching an operator how to appropriately use the equipment. In this respect, for example, if a new or inexperienced operator depresses trigger 42 before face 54 of the blasting head is against the surface to be cleaned, abrasive material will not be discharged and an alarm signal will issue to indicate to the operator that he or she is not operating the equipment properly. In addition to these functions, it will be appreciated that the control arrangement provides for shutting down the abrasive flow and/or issuing an alarm signal in response to other conditions resulting in a drop in the vacuum pressure at switch 78 such as, for example, dirty filters in the vacuum tank or a malfunction of the vacuum equipment.

Figure 3:
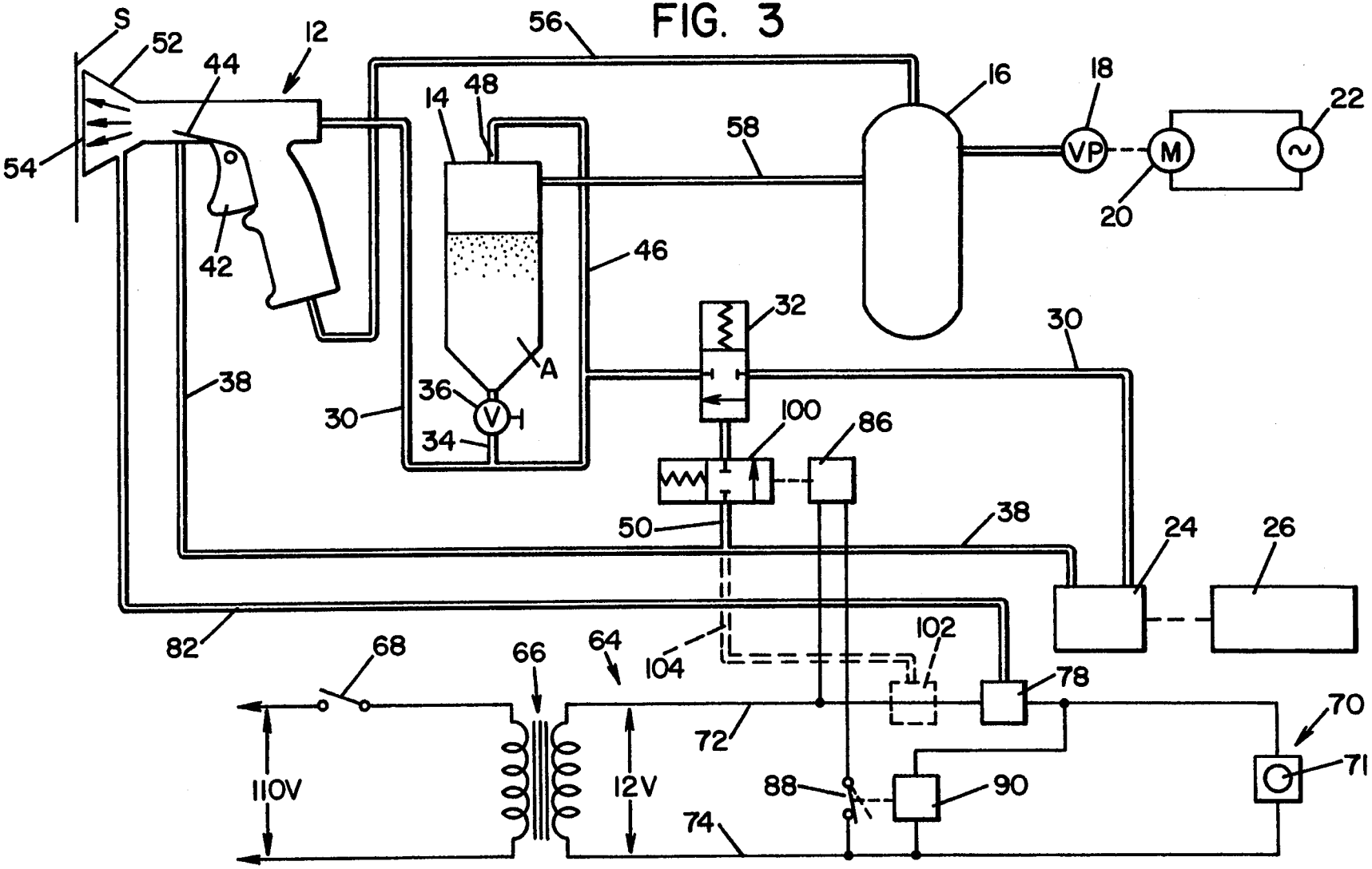
FIG. 3 is a schematic illustration of the system shown in FIG. 1 provided with another embodiment of a control arrangement according to the invention.

FIG. 3 illustrates a modification of the foregoing control arrangement. Otherwise, the components of the abrasive cleaning system and control arrangement are the same as those described hereinabove in conjunction with FIG. 2 of the drawing and, accordingly, are designated in FIG. 3 by like numerals. In the embodiment of FIG. 3, valve 84 in line 30 is eliminated and solenoid 86 operates to open a normally closed valve 100 provided in line 50 between compressor line 38 and flow control valve 32. With the exception of valve 100, the operation of the abrasive cleaning system and control arrangement shown in FIG. 3 is the same as that described hereinabove with regard to FIG. 2. In this respect, assuming the compressor and vacuum pump to have been activated whereby air under pressure flows through line 38 to blast head 12 and a vacuum is generated in shroud 52, tank 16 and line 82 to vacuum actuated switch 78, all as described hereinabove, the closure of on-off switch 68 energizes control circuit 64 and, because vacuum actuated switch 78 is in its normally closed position, the circuit to alarm 70 and solenoid 90 is closed across switch 78. Accordingly, light 71 is energized and switch 88 opens to deenergize solenoid 86 whereby valve 100 is in its closed position blocking air flow through line 50. When the operator positions face 54 of blast head 12 against surface S, the vacuum in shroud 52 and thus in line 82 is increased to open switch 78 as in the earlier embodiment. The opening of switch 78 disconnects alarm 70 and solenoid 90 from the circuit, whereby light 71 is extinguished and switch 88 closes to energize solenoid 86 to open valve 100 in line 50. When the operator depresses trigger 42 to initiate an abrasive cleaning operation, the back pressure in line 38 opens valve 32 by flow across valve 100 and air under pressure from compressor 24 then flows through line 30 to carry abrasive material from pressure tank 14 to blast head 12. If the operator cants face 54 of the blast head relative to surface S, there is a reduction in the vacuum at shroud 52 and thus in line 82 which is sensed by vacuum switch 78 through line 82 and in response to which the vacuum switch closes to close the circuit to alarm 70 and solenoid 90. Accordingly, the alarm is activated and solenoid 90 is energized to open switch 88 whereupon solenoid 86 is deenergized and valve 100 closes. This blocks air flow through line 50 to valve 32 whereby valve 32 closes to stop the flow of air under pressure from the compressor through line 30 and thus the flow of abrasive material to blast head 12. If the operator correctly repositions face 54 of shroud 52 relative to surface S, the vacuum increases in shroud 52 and thus in line 82 to switch 78, whereby the latter opens to disconnect alarm 70 and deenergize solenoid 90, whereby switch 88 closes to energize solenoid 86 which displaces valve 100 to the left in FIG. 3 to its open position, whereupon the abrasive cleaning operation is resumed.

Although alarm 70 in the foregoing embodiments illustrated in FIGS. 2 and 3 of the drawing is identified as a light on the blast head so as to be visible to the operator thereof, it will be appreciated that the alarm could, either additionally or alternatively, include an audible alarm such as a siren or horn. Furthermore, there can be more than one alarm, whether visual, audible or both, and the alarm or alarms can be located other than on the blast head or in other locations in addition to the blasting head. In the embodiments illustrated, and as described in conjunction therewith, the alarm will be actuated upon closure of on-off switch 68 until such time as the operator positions face 54 of blast head 12 against surface S so as to increase the vacuum pressure therein sufficiently to open vacuum actuated switch 78. When the alarm is a visual light as described hereinabove, such momentary lighting thereof is acceptable. Even if the alarm were audible, such momentary sounding thereof might also be acceptable. If not, a normally open pressure actuated switch 102 can be provided in secondary line 72, ahead of vacuum switch 78 and connected to air line 38 by a branch line 104 as indicated by the broken line designations of these components in FIG. 3 of the drawing. Switch 102 will not close until the operator depresses trigger 42 to create back pressure in line 38 and, accordingly, alarm 70 and solenoid 90 will not be actuated other than in response to an unacceptable condition at the blast head. The alarm and solenoid are prepared to be actuated when the operator both appropriately positions face 54 relative to surface S to increase the vacuum pressure to open switch 78 and depresses trigger 42 to create a back pressure to close switch 102. The control circuit then functions as described above in response to switch 78 sensing an inappropriate vacuum level at shroud 52. If the operator releases trigger 42 in response to the alarm or the interruption of the flow of abrasive material to the blast head, as opposed to appropriately repositioning face 54 of shroud 52 relative to surface S, valve 44 opens causing a pressure drop in line 38 and thus line 104 whereupon pressure actuated switch 102 opens. The opening of switch 102 disconnects alarm 70 and solenoid 90 whereupon switch 88 closes to connect solenoid 86 across lines 72 and 74 to open valve 100 in preparation for resuming the cleaning operation. Until such time as cleaning is resumed by properly positioning face 54 relative to surface S and depressing trigger 42, alarm 70 remains deactivated. Therefore, it will be appreciated that if the operator releases trigger 42 during normal operation of the abrasive blasting system, such as to reposition blast head 12 relative to surface S, the pressure drop in line 38 and thus line 104 opens switch 102 so as to preclude actuation of alarm 70 during normal, appropriate use of the equipment. Likewise, the alarm is not actuated during start-up of system 10 and closure of on-off switch 68 of the control circuit in that pressure switch 102 is open until such time as the operator depresses trigger 42.

While considerable emphasis has been placed on the embodiments herein illustrated and described, it will be appreciated that other embodiments of the invention can be devised and that many changes can be made in the embodiments disclosed herein without departing from the principals of the present invention. In particular in this respect, it will be appreciated that a control arrangement according to the invention is applicable to an abrasive cleaning system wherein material is abrasively removed from a surface other than by impelling an abrasive material such as sand thereagainst. For example, an electric or pneumatically driven rotatable abrading wheel supported within a shroud connected to a source of vacuum for recovering material removed from the surface could readily be provided with a control arrangement operable as described herein to actuate an alarm and/or interrupt the abrading operation in response to a displacement of the shroud which would result in a drop in the vacuum pressure at the shroud indicating an inappropriate disposition of the shroud relative to the surface being cleaned. Likewise, circuitry other than that illustrated herein can be readily devised to perform the desired alarm and/or shut-down functions. In the embodiments illustrated, for example, the vacuum line to normally closed vacuum actuated switch 78 could be directly connected to the vacuum tank or to the vacuum line between the blast head and vacuum tank. As a further example, control valves 84 and 100 could be normally closed valves pneumatically actuated through the vacuum system so as to open and close the air lines 30 and 50 with which they are associated in response respectively to high and low vacuum pressures at the blast head indicative of the inappropriate positioning of the blast head. In a further modification of the disclosed embodiments, vacuum switch 78 can have a second closed position in response to an excessively high vacuum pressure in line 82 which would result, for example, from a crimp in vacuum line 56 or a blockage therein. This would provide for the control arrangement to respond to both a low pressure indicative of inappropriate positioning of face 54 of the blast head and an excessively high pressure indicative of another malfunction to be brought to the attention of the operator.

The foregoing and other modifications of the disclosed embodiments as well as other embodiments of the invention will be suggested and obvious to those skilled in the art from the disclosure herein, whereby it is to be distinctly understood that the foregoing descriptive matter is to be interpreted merely as illustrative of the present invention and not as a limitation.

Having thus described the invention, it is claimed:

1. In a system for abrasively cleaning a surface including a source of abrasive material, shroud means for directing abrasive material against said surface, means including a source of air under pressure for delivering abrasive material from said source to said shroud means, and means for generating a vacuum at said shroud means for recovering abrasive material delivered to said shroud means and material removed from said surface, the improvement comprising: electrical control circuit means including vacuum sensing vacuum responsive electrical switch means for sensing an unacceptable vacuum level at said shroud means, and means responsive to said vacuum sensing switch means for indicating said unacceptable vacuum level.

2. The improvement according to claim 1, wherein said means responsive to said vacuum sensing switch means is alarm means.

3. The improvement according to claim 2, wherein said alarm means includes a visual alarm.

4. The improvement according to claim 1, wherein said means responsive to said vacuum sensing switch means includes valve means for blocking the flow of abrasive material to said shroud means.

5. The improvement according to claim 4, wherein said means responsive to said vacuum sensing switch means includes alarm means.

6. The improvement according to claim 5, wherein said alarm means includes a visual alarm.

7. A system for abrasively cleaning a surface including a source of abrasive material, shroud means for directing abrasive material against said surface, a source of air under pressure, line means connecting said source of air under pressure with said source of abrasive material and said shroud means for delivering said abrasive material from said source thereof to said shroud means, valve means in said line means between said source of air under pressure and said source of abrasive material, said valve means having opened and closed positions respectively opening and closing said line means with respect to the flow of air therethrough from said source of air, means for generating a vacuum at said shroud means for removing abrasive material delivered to said shroud means, electrical control circuit means including vacuum responsive electrical switch means responsive to a change in vacuum pressure, having first and second modes respectively corresponding to acceptable and unacceptable vacuum levels at said shroud means, and alarm means responsive to said switch means in said second mode thereof.

8. The system according to claim 7, wherein said alarm means includes an audible alarm.

9. The system according to claim 7, and means responsive to said switch means in said second mode to close said valve means.

10. The system according to claim 9, wherein said alarm means includes an audible alarm.

11. A system for abrasively cleaning a surface including a source of abrasive material, shroud means for directing abrasive material against said surface, a source of air under pressure, line means connecting said source of air under pressure with said source of abrasive material and said shroud means for delivering said abrasive material from said source thereof to said shroud means , valve means in said line means between said source of air under pressure and said source of abrasive material, said valve means having opened and closed positions respectively opening and closing said line means with respect to the flow of air therethrough from said source of air, means for generating a vacuum at said shroud means for removing abrasive material delivered to said shroud means, vacuum responsive switch means having first and second modes respectively corresponding to acceptable and unacceptable vacuum levels at said shroud means, alarm means responsive to said switch means in said second mode thereof, said valve means including first and second valves each having open and closed positions respectively opening and closing said line means, control means adjacent said shroud means for opening and closing said first valve, and said means responsive to said switch means in said second mode to close said valve means including means to close said second valve.

12. The system according to claim 11, wherein said alarm means includes an audible alarm.

13. A system for abrasively cleaning a surface including a source of abrasive material, shroud means for directing abrasive material against said surface, a source of air under pressure, line means connecting said source of air under pressure with said source of abrasive material and said shroud means for delivering said abrasive material from said source thereof to said shroud means, valve means in said line means between said source of air under pressure and said source of abrasive material, said valve means having opened and closed positions respectively opening and closing said line means with respect to the flow of air therethrough from said source of air, means for generating a vacuum at said shroud means for removing abrasive material delivered to said shroud means, electrical control circuit means including vacuum responsive electrical switch means responsive to a change in vacuum pressure, having first and second modes respectively corresponding to acceptable and unacceptable vacuum levels at said shroud means, and means responsive to said switch means in said second mode to close said valve means.

14. A system for abrasively cleaning a surface including a source of abrasive material, shroud means for directing abrasive material against said surface, a source of air under pressure, line means connecting said source of air under pressure with said source of abrasive material and said shroud means for delivering said abrasive material from said source thereof to said shroud means, valve means in said line means between said source of air under pressure and said source of abrasive material, said valve means having opened and closed positions respectively opening and closing said line means with respect to the flow of air therethrough from said source of air, means for generating a vacuum at said shroud means for removing abrasive material delivered to said shroud means, vacuum responsive switch means having first and second modes respectively corresponding to acceptable and unacceptable vacuum levels at said shroud means, and means responsive to said switch means in said second mode to close said valve means, said valve means including first and second valves each having open and closed positions respectively opening and closing said line means, control means adjacent said shroud means for opening and closing said first valve, and said means responsive to said switch means in said second mode to close said valve means including means to close said second valve.

15. A system for abrasively cleaning a surface including a source of abrasive material, shroud means for directing abrasive material against said surface, a source of air under pressure, first line means connecting said source of air under pressure with said source of abrasive material and said shroud means for delivering said abrasive material from said source thereof to said shroud means, pressure actuated valve means in said first line means having opened and closed positions respectively opening and closing said first line means with respect to the flow of air therethrough from said source of air, second line means connecting said source of air under pressure with said shroud means and said pressure actuated valve means, manually operable valve means at said shroud means having first and second positions respectively opening and closing said second line means, whereby air in said second line means is respectively at a first pressure for opening said pressure actuated valve means and a second pressure lower than said first pressure and at which said pressure actuated valve means closes, means for generating a vacuum at said shroud means for removing abrasive material delivered to said shroud means, means for sensing an unacceptable vacuum level at said shroud means, and control valve means in one of said first and second line means for precluding the flow of air through said first line means in response to said means for sensing an unacceptable vacuum level at said shroud means.

16. The system according to claim 15, wherein said control valve means is in said first line means between said source of air and said pressure actuated valve means.

17. The system according to claim 15, wherein said control valve means is in said second line means between said manually operable valve means and said pressure responsive valve means.

* * * * *